US009920901B2

(12) United States Patent
Wilcox et al.

(10) Patent No.: US 9,920,901 B2
(45) Date of Patent: Mar. 20, 2018

(54) LED LENSING ARRANGEMENT

(71) Applicant: Cree, Inc., Durham, NC (US)

(72) Inventors: Kurt Wilcox, Libertyville, IL (US); Craig Raleigh, Burlington, WI (US); Mario Alberto Castillo, Racine, WI (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/638,242

(22) Filed: Mar. 4, 2015

(65) Prior Publication Data

US 2015/0241021 A1 Aug. 27, 2015

Related U.S. Application Data

(63) Continuation-in-part of application No. 13/843,928, filed on Mar. 15, 2013, and a continuation-in-part of application No. 14/462,426, filed on Aug. 18, 2014, and a continuation-in-part of application No. 14/462,391, filed on Aug. 18, 2014, now Pat. No.
(Continued)

(51) Int. Cl.

| | |
|---|---|
| ***F21V 5/04*** | (2006.01) |
| ***F21V 5/00*** | (2018.01) |
| *F21Y 105/10* | (2016.01) |
| *F21Y 115/10* | (2016.01) |

(52) U.S. Cl.
CPC ..... *F21V 5/04* (2013.01); *F21V 5/007* (2013.01); *F21Y 2105/10* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 319,818 | A | 6/1885 | Howard |
| 3,138,147 | A | 6/1964 | Bancel |

(Continued)

FOREIGN PATENT DOCUMENTS

| | | | |
|---|---|---|---|
| DE | 20014114 | U1 | 12/2000 |
| DE | 20107425 | U1 | 8/2001 |

(Continued)

OTHER PUBLICATIONS

Focus on Precision-Injection Molding Optical Components by Michael Stricker, et al.; Translated from Kunststoffe Apr. 2009, pp. 30-34.

(Continued)

*Primary Examiner* — Jerry Rahll
(74) *Attorney, Agent, or Firm* — Jansson Munger McKinley & Kirby Ltd.

(57) ABSTRACT

An LED lensing arrangement for lighting fixtures includes (1) a rigid light-transmissive outer structure having an outwardly-facing light-exit surface and an outer-structure light-input surface, (2) an optically-clear molded polymeric inner structure having a light-entrance surface and a light-output surface which is adhered to the outer-structure light-input surface, the inner structure being of a material which is pourable upon molding, one example being a liquid silicone rubber (LSR) material, and (3) at least one LED light source secured with respect to and optically coupled to the inner-structure light-entrance surface.

41 Claims, 7 Drawing Sheets

Related U.S. Application Data

9,513,424, said application No. 14/462,426 is a continuation-in-part of application No. 13/842,521, filed on Mar. 15, 2013, now Pat. No. 9,519,095, said application No. 14/462,391 is a continuation-in-part of application No. 13/842,521, filed on Mar. 15, 2013, now Pat. No. 9,519,095.

(60) Provisional application No. 62/005,955, filed on May 30, 2014, provisional application No. 62/009,039, filed on Jun. 6, 2014.

(56) References Cited

U.S. PATENT DOCUMENTS 3,142,207 A 7/1964 Grob
3,372,740 A 3/1968 Kastovich et al.
3,532,871 A 10/1970 Shipman
4,146,297 A 3/1979 Alferness et al.
4,441,787 A 4/1984 Lichtenberger
4,714,983 A 12/1987 Lang et al.
4,808,101 A 2/1989 Schad et al.
4,914,553 A 4/1990 Hamada et al.
4,954,930 A 9/1990 Maegawa et al.
4,977,486 A 12/1990 Gotoh
5,005,108 A 4/1991 Pristash et al.
5,009,483 A 4/1991 Rockwell et al.
5,014,165 A 5/1991 Naganawa
5,026,161 A 6/1991 Werner
5,040,098 A 8/1991 Tanaka et al.
5,047,761 A 9/1991 Sell et al.
5,061,404 A 10/1991 Wu et al.
5,097,258 A 3/1992 Iwaki
5,113,177 A 5/1992 Cohen et al.
5,113,472 A 5/1992 Gualtieri
5,171,060 A 12/1992 Bathurst
5,175,787 A 12/1992 Gualtieri et al.
5,186,865 A 2/1993 Wu et al.
5,223,275 A 6/1993 Gellert
5,245,689 A 9/1993 Gualtieri
5,253,317 A 10/1993 Allen
5,295,019 A 3/1994 Rapoport et al.
5,309,544 A 5/1994 Saxe
5,359,687 A 10/1994 McFarland et al.
5,359,691 A 10/1994 Tai et al.
5,396,350 A 3/1995 Beeson et al.
5,398,179 A 3/1995 Pacheco et al.
5,400,224 A 3/1995 Dunah et al.
5,428,468 A 6/1995 Zimmerman et al.
5,461,547 A 10/1995 Ciupke et al.
5,462,700 A 10/1995 Beeson et al.
5,481,385 A 1/1996 Zimmerman et al.
5,494,615 A 2/1996 Wang
5,506,924 A 4/1996 Inoue
5,521,725 A 5/1996 Beeson et al.
5,521,726 A 5/1996 Zimmerman et al.
5,528,720 A 6/1996 Winston et al.
5,537,304 A 7/1996 Klaus
5,541,039 A 7/1996 McFarland et al.
5,548,670 A 8/1996 Koike et al.
5,553,092 A 9/1996 Bruce et al.
5,555,109 A 9/1996 Zimmerman et al.
5,555,160 A 9/1996 Tawara et al.
5,555,329 A 9/1996 Kuper et al.
5,572,411 A 11/1996 Watai et al.
5,577,492 A 11/1996 Parkyn, Jr. et al.
5,584,556 A 12/1996 Yokoyama et al.
5,598,280 A 1/1997 Nishio et al.
5,598,281 A 1/1997 Zimmerman et al.
5,613,751 A 3/1997 Parker et al.
5,613,770 A 3/1997 Chin et al.
5,657,408 A 8/1997 Ferm et al.
5,658,066 A 8/1997 Hirsch
5,659,410 A 8/1997 Koike et al.
5,661,210 A * 8/1997 Burns ..... C08K 9/06 524/493
5,676,453 A 10/1997 Parkyn, Jr. et al.
5,676,457 A 10/1997 Simon
5,677,702 A 10/1997 Inoue et al.
5,685,634 A 11/1997 Mulligan
5,696,865 A 12/1997 Beeson et al.
5,702,176 A 12/1997 Engle
5,718,497 A 2/1998 Yokoyama et al.
5,719,619 A 2/1998 Hattori et al.
5,727,107 A 3/1998 Umemoto et al.
5,735,590 A 4/1998 Kashima et al.
5,739,931 A 4/1998 Zimmerman et al.
5,748,828 A 5/1998 Steiner et al.
5,761,355 A 6/1998 Kuper et al.
5,769,522 A 6/1998 Kaneko et al.
5,771,039 A 6/1998 Ditzik et al.
5,777,857 A 7/1998 Degelmann
5,806,955 A 9/1998 Parkyn, Jr. et al.
5,812,714 A 9/1998 Hulse
5,818,555 A 10/1998 Yokoyama et al.
5,839,823 A 11/1998 Hou et al.
5,850,498 A 12/1998 Shacklette et al.
5,854,872 A 12/1998 Tai
5,863,113 A 1/1999 Oe et al.
5,872,883 A 2/1999 Ohba et al.
5,897,201 A 4/1999 Simon et al.
5,914,759 A 6/1999 Higuchi et al.
5,914,760 A 6/1999 Daiku
5,949,933 A 9/1999 Steiner et al.
5,954,423 A 9/1999 Logan et al.
5,961,198 A 10/1999 Hira et al.
5,967,637 A 10/1999 Ishikawa et al.
5,974,214 A 10/1999 Shacklette et al.
5,997,148 A 12/1999 Ohkawa
5,999,281 A 12/1999 Abbott et al.
5,999,685 A 12/1999 Goto et al.
6,007,209 A 12/1999 Pelka
6,043,951 A 3/2000 Lee
6,044,196 A 3/2000 Winston et al.
6,079,838 A 6/2000 Parker et al.
6,097,549 A 8/2000 Jenkins et al.
6,107,222 A 8/2000 Joseph et al.
6,123,889 A 9/2000 Katagiri et al.
6,134,092 A 10/2000 Pelka et al.
6,139,176 A 10/2000 Hulse et al.
6,151,089 A 11/2000 Yang et al.
6,155,692 A 12/2000 Ohkawa
6,161,939 A 12/2000 Bansbach
6,164,790 A 12/2000 Lee
6,164,791 A 12/2000 Gwo-Juh et al.
6,167,182 A 12/2000 Shinohara et al.
6,206,535 B1 3/2001 Hattori et al.
6,231,200 B1 5/2001 Shinohara et al.
6,232,592 B1 5/2001 Sugiyama
6,241,363 B1 6/2001 Lee
6,257,737 B1 7/2001 Marshall et al.
6,259,854 B1 7/2001 Shinji et al.
D446,333 S 8/2001 Frois
6,304,693 B1 10/2001 Buelow, II et al.
6,310,704 B1 10/2001 Dogan et al.
6,379,016 B1 4/2002 Boyd et al.
6,379,017 B2 4/2002 Nakabayashi et al.
6,395,201 B1 5/2002 Hunt et al.
6,400,086 B1 6/2002 Huter et al.
6,421,103 B2 7/2002 Yamaguchi
6,443,594 B1 9/2002 Marshall et al.
6,461,007 B1 10/2002 Akaoka
6,473,554 B1 10/2002 Pelka et al.
6,480,307 B1 11/2002 Yang
6,485,157 B2 11/2002 Ohkawa
6,499,870 B1 12/2002 Zwick et al.
6,502,956 B1 1/2003 Wu
6,508,563 B2 1/2003 Parker et al.
6,523,986 B1 2/2003 Hoffmann
6,541,720 B2 4/2003 Gerald et al.
6,554,451 B1 4/2003 Keuper
6,568,819 B1 5/2003 Yamazaki et al.
6,582,103 B1 6/2003 Popovich et al.
6,585,356 B1 7/2003 Ohkawa
6,598,998 B2 7/2003 West et al.

(56) References Cited

U.S. PATENT DOCUMENTS 6,606,199 B2 8/2003 Wang
6,612,723 B2 9/2003 Futhey et al.
6,616,290 B2 9/2003 Ohkawa
6,629,764 B1 10/2003 Uehara
6,633,722 B1 10/2003 Kohara et al.
6,634,772 B2 10/2003 Yaphe et al.
6,636,363 B2 10/2003 Kaminsky et al.
6,647,199 B1 11/2003 Pelka et al.
6,652,109 B2 11/2003 Nakamura
6,659,628 B2 12/2003 Gomez Del Campo
6,671,452 B2 12/2003 Winston et al.
6,676,284 B1 1/2004 Wynne Willson
6,678,021 B2 1/2004 Ohkawa
6,679,621 B2 1/2004 West et al.
6,712,481 B2 3/2004 Parker et al.
6,724,529 B2 4/2004 Sinkoff
6,724,543 B1 4/2004 Chinniah et al.
6,727,965 B1 4/2004 Kubota
6,752,505 B2 6/2004 Parker et al.
6,755,546 B2 6/2004 Ohkawa
6,758,582 B1 7/2004 Hsiao et al.
6,775,460 B2 8/2004 Steiner et al.
6,796,676 B2 9/2004 Severtson et al.
6,802,628 B2 10/2004 Kuo
6,840,656 B2 1/2005 Kuo
6,845,212 B2 1/2005 Gardiner et al.
6,876,408 B2 4/2005 Yamaguchi
6,894,740 B2 5/2005 Ohkawa
6,896,381 B2 5/2005 Benitez et al.
6,924,943 B2 8/2005 Minano et al.
6,942,360 B2 9/2005 Chou et al.
D511,221 S 11/2005 Zucker
6,974,241 B2 12/2005 Hara et al.
6,992,335 B2 1/2006 Ohkawa
D518,911 S 4/2006 Lee
7,025,482 B2 4/2006 Yamashita et al.
7,046,318 B2 5/2006 Yu et al.
7,046,905 B1 5/2006 Gardiner et al.
7,056,567 B2 6/2006 O'Neill et al.
7,063,430 B2 6/2006 Greiner
7,072,096 B2 7/2006 Holman et al.
7,083,313 B2 8/2006 Smith
7,085,460 B2 8/2006 Leu et al.
7,090,370 B2 8/2006 Clark et al.
7,090,389 B2 8/2006 Parker et al.
7,097,341 B2 8/2006 Tsai
7,106,528 B2 9/2006 Ohmori et al.
7,118,253 B1 10/2006 Simon
D532,532 S 11/2006 Maxik
7,131,764 B2 11/2006 Hsu et al.
7,152,985 B2 12/2006 Benitez et al.
7,160,010 B1 1/2007 Chinniah et al.
7,160,015 B2 1/2007 Parker
7,168,841 B2 1/2007 Hsieh et al.
7,175,330 B1 2/2007 Chen
7,178,941 B2 2/2007 Roberge et al.
7,182,480 B2 2/2007 Kan
7,192,174 B2 3/2007 Myoung
7,204,634 B2 4/2007 Chen et al.
7,209,628 B2 4/2007 Winston et al.
7,222,995 B1 5/2007 Bayat et al.
7,223,004 B2 5/2007 Chen et al.
D544,110 S 6/2007 Hooker et al.
7,246,931 B2 7/2007 Hsieh et al.
7,265,800 B2 9/2007 Jagt et al.
7,273,299 B2 9/2007 Parkyn et al.
7,292,767 B2 11/2007 Cheng
D563,036 S 2/2008 Miyairi et al.
D565,778 S 4/2008 Pedersen
D566,300 S 4/2008 Lo
7,364,342 B2 4/2008 Parker et al.
D568,529 S 5/2008 Colleran, Jr. et al.
D570,025 S 5/2008 Walker
D573,292 S 7/2008 Zheng et al.
7,393,124 B1 7/2008 Williams
7,399,108 B2 7/2008 Ayabe et al.
7,400,809 B2 7/2008 Erben et al.
7,404,660 B2 7/2008 Parker
D575,898 S 8/2008 Tran et al.
7,407,303 B2 * 8/2008 Wanninger ..... G02B 6/003 362/227
7,422,357 B1 9/2008 Chang
D581,555 S 11/2008 To et al.
7,458,714 B2 12/2008 Chang
7,465,074 B2 12/2008 Blumel
D584,838 S 1/2009 To et al.
7,486,854 B2 2/2009 Van Ostrand et al.
7,488,093 B1 2/2009 Huang et al.
D587,839 S 3/2009 Guercio
D589,195 S 3/2009 Sabernig
7,513,672 B2 4/2009 Parker
7,520,650 B2 4/2009 Smith
7,534,013 B1 5/2009 Simon
7,559,672 B1 7/2009 Parkyn et al.
7,566,148 B2 7/2009 Noh et al.
7,566,159 B2 7/2009 Oon et al.
7,581,854 B2 9/2009 Ford
7,587,117 B2 9/2009 Winston et al.
D604,002 S 11/2009 Santoro
7,614,764 B2 11/2009 Williams et al.
7,626,655 B2 12/2009 Yamazaki et al.
7,628,508 B2 12/2009 Kita et al.
7,635,205 B2 12/2009 Yu et al.
7,639,918 B2 12/2009 Sayers et al.
7,641,363 B1 1/2010 Chang et al.
7,648,256 B2 1/2010 Shiratsuchi et al.
D609,384 S 2/2010 Gray et al.
D612,527 S 3/2010 Espiau et al.
7,674,018 B2 3/2010 Holder et al.
7,682,533 B2 3/2010 Iatan
7,682,853 B2 3/2010 Ashida
7,703,950 B2 4/2010 Ewert et al.
7,703,967 B2 4/2010 Parker
D615,232 S 5/2010 Xiao et al.
D616,145 S 5/2010 Boissevain
7,710,663 B2 5/2010 Barnes et al.
7,722,196 B2 5/2010 Caire et al.
7,722,224 B1 5/2010 Coleman et al.
7,722,241 B2 5/2010 Chang
7,724,321 B2 5/2010 Hsieh et al.
D617,489 S 6/2010 Santoro
D618,842 S 6/2010 Ngai et al.
7,736,019 B2 6/2010 Shimada et al.
7,736,045 B2 6/2010 Yamashita et al.
7,750,982 B2 7/2010 Nelson et al.
7,753,551 B2 7/2010 Yaphe et al.
7,758,227 B1 7/2010 Coleman
7,760,290 B2 7/2010 Kang et al.
7,762,705 B2 7/2010 Sakai et al.
D622,894 S 8/2010 Ngai et al.
7,766,515 B2 8/2010 Condon et al.
7,776,236 B2 8/2010 Shih et al.
7,780,306 B2 8/2010 Hoshi
7,784,954 B1 8/2010 Coleman
D623,793 S 9/2010 Ngai et al.
7,798,695 B2 9/2010 Parker
D626,260 S 10/2010 Wei
7,806,581 B2 10/2010 Lee
7,810,960 B1 10/2010 Soderman et al.
7,810,968 B1 10/2010 Walker et al.
7,813,131 B2 10/2010 Liang
7,821,982 B2 10/2010 Chen et al.
D627,913 S 11/2010 Gielen
D628,319 S 11/2010 Yoshinobu et al.
7,826,698 B1 11/2010 Meir et al.
D629,129 S 12/2010 Lin et al.
7,850,357 B2 12/2010 Kim et al.
7,857,619 B2 12/2010 Liu
D630,347 S 1/2011 Pei et al.
D630,775 S 1/2011 Pan
D631,577 S 1/2011 Yoshinobu et al.
D631,601 S 1/2011 Lodhie
7,866,871 B2 1/2011 Couzin et al.
D633,636 S 3/2011 Gielen

(56) References Cited

U.S. PATENT DOCUMENTS

D634,056 S 3/2011 Hokazono et al.
7,905,646 B2 3/2011 Adachi et al.
7,907,804 B2 3/2011 Meir et al.
7,914,192 B2 3/2011 Coleman
7,914,193 B2 3/2011 Peifer et al.
7,914,196 B2 3/2011 Parker et al.
7,918,590 B1 4/2011 Li et al.
7,929,816 B2 4/2011 Meir et al.
7,934,851 B1 5/2011 Boissevain et al.
7,967,477 B2 6/2011 Bloemen et al.
7,969,531 B1 6/2011 Li et al.
D641,923 S 7/2011 Radchenko et al.
7,976,204 B2 7/2011 Li et al.
D642,725 S 8/2011 Kong et al.
7,991,257 B1 8/2011 Coleman
7,997,784 B2 8/2011 Tsai
8,002,450 B2 8/2011 Van Ostrand et al.
D645,194 S 9/2011 Budike, Jr. et al.
D646,406 S 10/2011 Tsai et al.
8,033,674 B1 10/2011 Coleman et al.
8,033,706 B1 10/2011 Kelly et al.
8,038,308 B2 10/2011 Greiner
8,047,696 B2 11/2011 Ijzerman et al.
8,052,316 B2 11/2011 Lee
8,054,409 B2 11/2011 Hsieh et al.
8,061,877 B2 11/2011 Chang
8,064,743 B2 11/2011 Meir et al.
8,067,884 B2 11/2011 Li
8,075,157 B2 12/2011 Zhang et al.
8,087,807 B2 1/2012 Liu et al.
8,092,068 B2 1/2012 Parker et al.
8,096,671 B1 1/2012 Cronk et al.
8,096,681 B2 1/2012 Fang et al.
D654,618 S 2/2012 Kong et al.
8,113,704 B2 2/2012 Bae et al.
8,128,272 B2 3/2012 Fine et al.
8,129,731 B2 3/2012 Vissenberg et al.
8,152,339 B2 4/2012 Morgan
8,152,352 B2 4/2012 Richardson
8,162,524 B2 4/2012 Van Ostrand et al.
D659,880 S 5/2012 Maxik et al.
8,172,447 B2 5/2012 Meir et al.
8,177,408 B1 5/2012 Coleman
8,182,128 B2 5/2012 Meir et al.
8,186,847 B2 5/2012 Hu et al.
D662,255 S 6/2012 Klu
D662,256 S 6/2012 Klu
D662,643 S 6/2012 Takahashi et al.
8,192,051 B2 6/2012 Dau et al.
8,198,109 B2 6/2012 Lerman et al.
8,210,716 B2 7/2012 Lerman et al.
8,215,814 B2 7/2012 Marcoux et al.
8,218,920 B2 7/2012 Van Ostrand et al.
8,220,955 B2 7/2012 Kwak et al.
8,220,980 B2 7/2012 Gingrich, III
8,226,287 B2 7/2012 Teng et al.
8,231,256 B1 7/2012 Coleman et al.
8,231,258 B2 7/2012 Kim et al.
8,231,259 B2 7/2012 Keller et al.
8,235,547 B2 8/2012 Hofmann
8,242,518 B2 8/2012 Lerman et al.
8,246,187 B2 8/2012 Cheong et al.
8,246,197 B2 8/2012 Huang
8,249,408 B2 8/2012 Coleman
8,258,524 B2 9/2012 Tan et al.
8,272,756 B1 9/2012 Patrick
8,272,770 B2 9/2012 Richardson
D668,370 S 10/2012 Guercio et al.
D669,624 S 10/2012 Daniels
8,277,106 B2 10/2012 Van Gorkom et al.
8,282,261 B2 10/2012 Pance et al.
8,283,853 B2 10/2012 Yan et al.
8,287,152 B2 10/2012 Gill
8,292,482 B2 10/2012 Harbers et al.
8,297,801 B2 10/2012 Coushaine et al.
8,297,818 B2 10/2012 Richardson
D670,422 S 11/2012 Siekmann et al.
D670,856 S 11/2012 Butler et al.
8,314,566 B2 11/2012 Steele et al.
8,317,363 B2 11/2012 Zheng
8,317,366 B2 11/2012 Dalton et al.
8,328,403 B1 12/2012 Morgan et al.
8,328,406 B2 12/2012 Zimmermann
8,330,176 B2 12/2012 Thompson et al.
8,331,746 B2 12/2012 Bogner et al.
8,338,199 B2 12/2012 Lerman et al.
8,338,839 B2 12/2012 Lerman et al.
8,338,840 B2 12/2012 Lerman et al.
8,338,841 B2 12/2012 Lerman et al.
8,338,842 B2 12/2012 Lerman et al.
8,344,397 B2 1/2013 Lerman et al.
8,348,446 B2 1/2013 Nakamura
8,348,461 B2 1/2013 Wilcox et al.
8,353,606 B2 1/2013 Jeong
8,369,678 B2 2/2013 Chakmakjian et al.
8,382,354 B2 2/2013 Kim et al.
8,382,387 B1 2/2013 Sandoval
D677,806 S 3/2013 Jiang et al.
8,388,173 B2 3/2013 Sloan et al.
8,388,190 B2 3/2013 Li et al.
8,398,259 B2 3/2013 Kwak et al.
8,398,262 B2 3/2013 Sloan et al.
D679,437 S 4/2013 Watt
D679,444 S 4/2013 Vasylyev
D679,843 S 4/2013 Hsu et al.
D681,262 S 4/2013 Lee
8,408,737 B2 4/2013 Wright et al.
8,410,726 B2 4/2013 Dau et al.
8,412,010 B2 4/2013 Ghosh et al.
8,414,154 B2 4/2013 Dau et al.
8,419,219 B2 4/2013 Yamamoto
8,419,224 B2 4/2013 Wan-Chih et al.
8,430,536 B1 4/2013 Zhao
8,430,548 B1 4/2013 Kelly et al.
8,432,628 B2 4/2013 Shiau et al.
8,434,892 B2 5/2013 Zwak et al.
8,434,893 B2 5/2013 Boyer et al.
8,434,913 B2 5/2013 Vissenberg
8,434,914 B2 5/2013 Li et al.
8,449,128 B2 5/2013 Ko et al.
8,449,142 B1 5/2013 Martin et al.
D684,296 S 6/2013 Henderson et al.
8,454,218 B2 6/2013 Wang et al.
8,459,848 B2 6/2013 Marley
8,461,602 B2 6/2013 Lerman et al.
8,469,559 B2 6/2013 Williams
8,475,010 B2 7/2013 Vissenberg et al.
8,485,684 B2 7/2013 Lou et al.
8,506,112 B1 8/2013 Dau et al.
8,534,896 B2 9/2013 Boonekamp
8,534,901 B2 9/2013 Panagotacos et al.
8,545,049 B2 10/2013 Davis et al.
8,547,022 B2 10/2013 Summerford et al.
8,567,983 B2 10/2013 Boyer et al.
8,567,986 B2 10/2013 Szprengiel et al.
D694,449 S 11/2013 Walker et al.
8,573,823 B2 11/2013 Dau et al.
8,585,253 B2 11/2013 Duong et al.
8,593,070 B2 11/2013 Wang et al.
D695,442 S 12/2013 Speier et al.
D695,447 S 12/2013 Speier et al.
8,598,778 B2 12/2013 Allen et al.
8,602,586 B1 12/2013 Dau et al.
8,602,605 B2 12/2013 Park et al.
8,608,351 B2 12/2013 Peifer
8,632,214 B1 1/2014 Tickner et al.
8,641,219 B1 2/2014 Johnson et al.
8,657,479 B2 2/2014 Morgan et al.
8,724,052 B2 5/2014 Hsieh et al.
8,755,005 B2 6/2014 Bierhuizen et al.
8,814,392 B1 8/2014 Lipowsky et al.
8,820,963 B2 9/2014 Olsen et al.
8,833,999 B2 9/2014 Wang et al.
8,864,360 B2 10/2014 Parker et al.

(56) References Cited

U.S. PATENT DOCUMENTS 8,870,431 B2 10/2014 Lin et al.
8,882,323 B2 11/2014 Solomon et al.
8,899,786 B1 12/2014 Moghal et al.
8,905,569 B2 12/2014 Thomas et al.
8,915,611 B2 12/2014 Zhang
8,917,962 B1 12/2014 Nichol et al.
2001/0019479 A1 9/2001 Nakabayashi et al.
2002/0061178 A1 5/2002 Winston et al.
2002/0172039 A1 11/2002 Inditsky
2004/0135933 A1 7/2004 Leu et al.
2004/0146241 A1 7/2004 Deladurantaye et al.
2004/0161490 A1 8/2004 Babin et al.
2004/0213003 A1 10/2004 Lauderdale et al.
2004/0240217 A1 12/2004 Rice
2005/0093430 A1 5/2005 Ibbetson et al.
2005/0111235 A1 5/2005 Suzuki et al.
2005/0168987 A1 8/2005 Tamaoki et al.
2005/0210643 A1 9/2005 Mezei et al.
2005/0231812 A1 10/2005 Leu et al.
2006/0002101 A1* 1/2006 Wheatley ..... G02B 6/0003 362/84
2006/0002146 A1 1/2006 Baba
2006/0105485 A1 5/2006 Basin et al.
2006/0262521 A1 11/2006 Piepgras et al.
2007/0081780 A1 4/2007 Scholl
2007/0086179 A1 4/2007 Chen et al.
2007/0121340 A1 5/2007 Hoshi
2007/0189033 A1 8/2007 Watanabe et al.
2007/0245607 A1 10/2007 Awai et al.
2007/0253058 A1 11/2007 Wood
2007/0274654 A1 11/2007 Choudhury et al.
2008/0037284 A1 2/2008 Rudisill
2008/0079182 A1 4/2008 Thompson et al.
2008/0137695 A1 6/2008 Takahashi et al.
2008/0165551 A1* 7/2008 Okada ..... G02B 6/0028 362/613
2008/0186273 A1 8/2008 Krijn et al.
2008/0192458 A1 8/2008 Li
2008/0198604 A1 8/2008 Kim et al.
2008/0285136 A1 11/2008 Jacobowitz et al.
2008/0298056 A1 12/2008 Petersen
2009/0039376 A1 2/2009 Uemoto et al.
2009/0159915 A1 6/2009 Branchevsky
2009/0257242 A1 10/2009 Wendman
2009/0309494 A1 12/2009 Patterson et al.
2010/0002449 A1 1/2010 Lin
2010/0027257 A1 2/2010 Boonekamp et al.
2010/0046219 A1 2/2010 Pijlman et al.
2010/0073597 A1 3/2010 Berhuizen et al.
2010/0079843 A1 4/2010 Derichs et al.
2010/0079980 A1 4/2010 Sakai
2010/0128483 A1 5/2010 Reo et al.
2010/0133422 A1 6/2010 Lin et al.
2010/0163909 A1 7/2010 Chen et al.
2010/0172135 A1 7/2010 Holder et al.
2010/0202142 A1 8/2010 Morgan
2010/0207140 A1 8/2010 Rudaz et al.
2010/0208460 A1 8/2010 Ladewig et al.
2010/0220484 A1 9/2010 Shani et al.
2010/0220497 A1 9/2010 Ngai
2010/0230693 A1 9/2010 Tran
2010/0231143 A1 9/2010 May et al.
2010/0238645 A1 9/2010 Bailey
2010/0238671 A1 9/2010 Catone et al.
2010/0271708 A1 10/2010 Wilcox
2010/0302218 A1 12/2010 Bita et al.
2010/0302616 A1 12/2010 Bita et al.
2010/0302783 A1 12/2010 Shastry et al.
2010/0302803 A1 12/2010 Bita et al.
2010/0308356 A1 12/2010 Wirth
2010/0315833 A1 12/2010 Holman et al.
2010/0328936 A1 12/2010 Pance et al.
2011/0007505 A1 1/2011 Wang
2011/0058372 A1 3/2011 Lerman et al.
2011/0063657 A1 3/2011 Li et al.
2011/0063830 A1 3/2011 Narendran et al.
2011/0063838 A1 3/2011 Dau et al.
2011/0069496 A1 3/2011 Ing et al.
2011/0163681 A1 7/2011 Dau et al.
2011/0163683 A1 7/2011 Steele et al.
2011/0170289 A1 7/2011 Allen et al.
2011/0176301 A1 7/2011 Liang et al.
2011/0180818 A1 7/2011 Lerman et al.
2011/0187273 A1 8/2011 Summerford et al.
2011/0193106 A1 8/2011 Lerman et al.
2011/0193114 A1 8/2011 Lerman et al.
2011/0195532 A1 8/2011 Lerman et al.
2011/0198631 A1 8/2011 Lerman et al.
2011/0198632 A1 8/2011 Lerman et al.
2011/0199769 A1 8/2011 Bretschneider et al.
2011/0204390 A1 8/2011 Lerman et al.
2011/0204391 A1 8/2011 Lerman et al.
2011/0210861 A1 9/2011 Winton
2011/0228527 A1 9/2011 Van Gorkom et al.
2011/0233568 A1 9/2011 An et al.
2011/0273882 A1 11/2011 Pickard
2011/0280043 A1 11/2011 Van Ostrand et al.
2011/0291548 A1 12/2011 Nguyen The et al.
2011/0299807 A1 12/2011 Kim et al.
2011/0305018 A1 12/2011 Angelini et al.
2011/0305027 A1 12/2011 Ham
2011/0317436 A1 12/2011 Kuan
2012/0003343 A1 1/2012 Armstrong et al.
2012/0008338 A1 1/2012 Ono et al.
2012/0014115 A1 1/2012 Park et al.
2012/0019942 A1 1/2012 Morgan
2012/0026728 A1 2/2012 Lou et al.
2012/0033445 A1 2/2012 Desmet et al.
2012/0039073 A1 2/2012 Tong
2012/0051041 A1 3/2012 Edmond et al.
2012/0068615 A1 3/2012 Duong et al.
2012/0091487 A1 4/2012 Chan et al.
2012/0113676 A1 5/2012 Van Dijk et al.
2012/0120651 A1 5/2012 Peck
2012/0152490 A1 6/2012 Wen et al.
2012/0170266 A1 7/2012 Germain et al.
2012/0170280 A1 7/2012 Choquet
2012/0170316 A1 7/2012 Lee et al.
2012/0170318 A1 7/2012 Tsai et al.
2012/0182767 A1 7/2012 Petcavich et al.
2012/0250296 A1 10/2012 Lu et al.
2012/0250319 A1 10/2012 Dau et al.
2012/0257383 A1 10/2012 Zhang
2012/0268931 A1 10/2012 Lerman et al.
2012/0268932 A1 10/2012 Lerman et al.
2012/0281404 A1 11/2012 Wilcox et al.
2012/0287654 A1 11/2012 He et al.
2012/0294011 A1 11/2012 Cattoni et al.
2012/0294037 A1* 11/2012 Holman ..... F21V 5/02 362/609
2012/0298181 A1 11/2012 Cashion et al.
2012/0307495 A1 12/2012 Shih
2012/0307503 A1 12/2012 Wilcox et al.
2012/0319592 A1 12/2012 Riesebosch
2012/0320626 A1 12/2012 Quilici et al.
2013/0010464 A1 1/2013 Shuja et al.
2013/0037838 A1 2/2013 Speier et al.
2013/0038219 A1 2/2013 Dau et al.
2013/0039050 A1 2/2013 Dau et al.
2013/0044480 A1 2/2013 Sato et al.
2013/0077298 A1 3/2013 Steele et al.
2013/0088890 A1 4/2013 Knapp et al.
2013/0107528 A1 5/2013 Boyer et al.
2013/0128593 A1 5/2013 Luo
2013/0148363 A1 6/2013 Choquet et al.
2013/0170210 A1 7/2013 Athalye
2013/0201715 A1 8/2013 Dau et al.
2013/0208461 A1 8/2013 Warton et al.
2013/0208495 A1 8/2013 Dau et al.
2013/0214300 A1 8/2013 Lerman et al.
2013/0215612 A1 8/2013 Garcia
2013/0223057 A1 8/2013 Gassner et al.
2013/0229804 A1 9/2013 Holder et al.
2013/0229810 A1 9/2013 Pelka et al.

(56) References Cited

U.S. PATENT DOCUMENTS

| | | | |
|---|---|---|---|
| 2013/0250584 | A1 | 9/2013 | Wang et al. |
| 2013/0279198 | A1 | 10/2013 | Lin et al. |
| 2013/0294059 | A1 | 11/2013 | Galluccio et al. |
| 2013/0294063 | A1 | 11/2013 | Lou et al. |
| 2013/0343045 | A1 | 12/2013 | Lodhie et al. |
| 2013/0343055 | A1 | 12/2013 | Eckert et al. |
| 2013/0343079 | A1 | 12/2013 | Unger et al. |
| 2014/0003041 | A1 | 1/2014 | Dau et al. |
| 2014/0029257 | A1 | 1/2014 | Boyer et al. |
| 2014/0071687 | A1 | 3/2014 | Tickner et al. |
| 2014/0111984 | A1 | 4/2014 | Rodgers et al. |
| 2014/0126206 | A1 | 5/2014 | Wilcox et al. |
| 2014/0168955 | A1 | 6/2014 | Gershaw |
| 2014/0268810 | A1 | 9/2014 | Marquardt et al. |
| 2014/0268879 | A1 | 9/2014 | Mizuyama et al. |
| 2014/0334126 | A1 | 11/2014 | Speier et al. |
| 2015/0003059 | A1 | 1/2015 | Haitz et al. |

FOREIGN PATENT DOCUMENTS

| | | | |
|---|---|---|---|
| DE | EP1167870 | A2 | 1/2002 |
| DE | 10047101 | A1 | 5/2002 |
| DE | 10047101 | C2 | 9/2002 |
| DE | 10203106 | A1 | 7/2003 |
| DE | 10302563 | A1 | 7/2004 |
| DE | 10302564 | A1 | 7/2004 |
| DE | 102006009325 | A1 | 9/2007 |
| DE | 102006011296 | A1 | 9/2007 |
| DE | 102006013343 | A1 | 9/2007 |
| DE | 202014100462 | U1 | 4/2014 |
| EP | 2495096 | A2 | 9/2012 |
| JP | 03019818 | A | 1/1991 |
| JP | 03138147 | A | 6/1991 |
| JP | 03142207 | A | 6/1991 |
| JP | 10173870 | A | 6/1998 |
| JP | 2000147264 | A | 5/2000 |
| JP | 3093080 | U | 4/2003 |
| WO | 199621122 | | 7/1996 |
| WO | 199621884 | | 7/1996 |
| WO | 199904531 | | 1/1999 |
| WO | 2003031869 | | 4/2003 |
| WO | 2008076399 | A2 | 6/2008 |
| WO | WO2008102655 | A1 | 8/2008 |
| WO | 2006076399 | A3 | 9/2008 |
| WO | 2009012484 | A1 | 1/2009 |
| WO | 2010095068 | A2 | 8/2010 |
| WO | 2010095068 | A3 | 10/2010 |
| WO | 2011091529 | A1 | 8/2011 |
| WO | 2011091529 | A4 | 10/2011 |
| WO | 2011130648 | A2 | 10/2011 |
| WO | 2011130648 | A3 | 2/2012 |
| WO | 2013078463 | A1 | 5/2013 |
| WO | 2013082537 | A1 | 6/2013 |
| WO | 2014120671 | A1 | 8/2014 |
| WO | 2014120672 | A2 | 8/2014 |
| WO | 2014120925 | A1 | 8/2014 |
| WO | 2014120968 | A1 | 8/2014 |
| WO | 2014120969 | A1 | 8/2014 |
| WO | 2014120672 | A3 | 9/2014 |
| WO | 2014144465 | A1 | 9/2014 |
| WO | 2014144503 | A1 | 9/2014 |
| WO | 2015199853 | A1 | 12/2015 |
| WO | 2016007231 | A1 | 1/2016 |

OTHER PUBLICATIONS

Plastic Optics, William S. Beich, accessed from http://www.photonics.com/EDU/Handbook.aspx?AID=25487 on Nov. 3, 2015.

Drain, Kieran, "Transformations in Lighting: 2011 DOE Solid-State Lighting R&D Workshop, Pane&D Workshop, Panel3: Novel Lighting Concepts for Large Interior Spaces," PowerPoint presentation, Nov. 2013 (23 pages). PowerPoint presentation, Nov. 2013 (23 pages). (See parent U.S. Appl. No. 13/842,521.).

Ji et al., "Electrically Controllable Microlens Array Fabricated by Anisotropic Phase Separation From Liquid-Crystal and Polymer Composite Materials," vol. 28, N" vol. 28, No. 13, Optics Letters, pp. 1147-1149, Jul. 1, 2003 (4 pages). (See parent U.S. Appl. No. 13/842,521.).

Iijima., et al., "Document Scanner Using Polymer Waveguides with a Microlens Array," Optical Engineer Optical Engineering, vol. 41, Issue 11, pp. 2743-2748, Oct. 28, 2002 (4 pages). (See parent U.S. Appl. No. 13/842,521.).

Web page at http://www.oluce.com/en/lamps/table/colombo-281-detail, printed Nov. 19, 2013 (2 pages). (See parent U.S. Appl. No. 13/842,521.).

Web page at http://www .fusionoptix.com/lighting/components/array-optics.htm, printed May 9, 2013 (2pages). (See parent U.S. Appl. No. 13/842,521.).

* cited by examiner

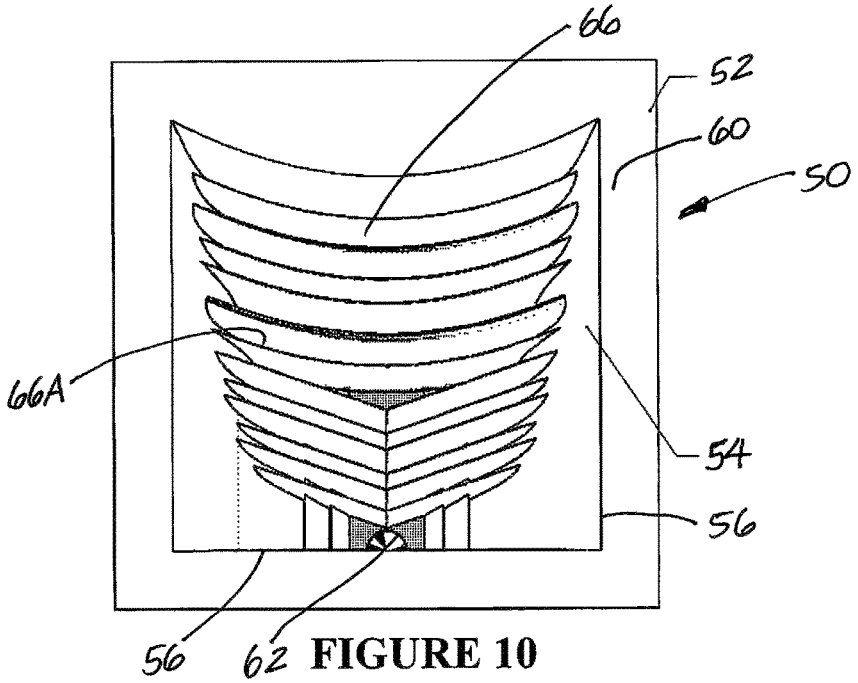
FIGURE 10
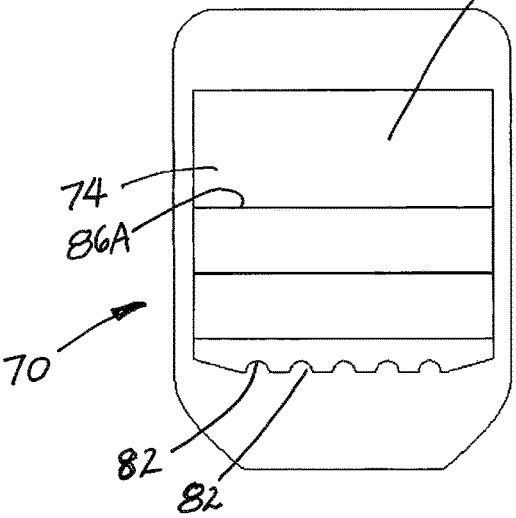
FIGURE 11
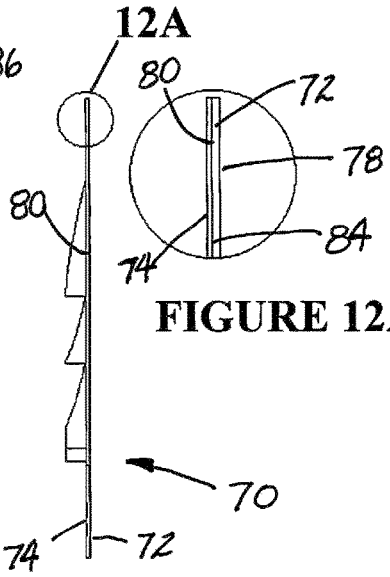
FIGURE 12
FIGURE 12A

LED LENSING ARRANGEMENT

RELATED APPLICATIONS

This application is a continuation-in-part of patent application Ser. No. 13/843,928, filed Mar. 15, 2013. This application is also a continuation-in-part of patent application Ser. Nos. 14/462,426 and 14/462,391, both filed Aug. 18, 2014, each of which in turn is a continuation-in-part of application Ser. No. 13/842,521, filed Mar. 15, 2013. This application is also based in part on Provisional Application Ser. No. 62/005,955, filed May 30, 2014, and on Provisional Application Ser. No. 62/009,039, filed Jun. 6, 2014. The contents of each of such applications are incorporated herein by reference in their entirety.

FIELD OF THE INVENTION

The invention relates generally to the field of LED lighting systems and, more particularly, relates to the lensing structures which are used with LED light sources in LED lighting fixtures.

BACKGROUND OF THE INVENTION

There is a need for lighting apparatus for a variety of general lighting purposes which is low-cost and energy-efficient. In the field of lighting, many different types of light sources have been developed. Recently, LED light sources involving multi-LED arrays, each with a large number of LED packages, have been developed as a means of bringing the many advantages of LED lighting—LED efficiency and long life—into the general illumination field. In particular, such LED light fixtures have been developed for use in outdoor settings, including by way of example lighting for parking lots, roadways, display areas and other large areas.

LED light sources are energy-efficient, and advances in LED technology are providing even greater efficiencies over time. One important aspect of LED light fixtures is the so-called secondary lensing that directs light received from LED light sources. Secondary lenses, which receive and direct light from LED light sources, are of significant importance to LED light fixtures in many ways.

Secondary lenses play a major role, of course, in the direction of light from a light fixture, and so determine the degree, spread and orientation of illumination, and overall optical efficiency. The forming and shaping of secondary lenses are typically important considerations with respect to the usefulness of an LED fixture and play a significant role in overall product cost. Improvements in secondary lenses, their optical capabilities, and their manufacture are important considerations in the field of LED light fixtures.

LED light fixtures for a wide variety of both specific and general lighting applications typically have a plurality of LED light sources, usually positioned in spaced relationship to one another on a board (e.g., a circuit board), and a secondary lens is aligned with each LED light source. One such configuration is disclosed in copending U.S. patent application Ser. No. 13/843,928 (Raleigh et al.), titled "Multi-layer Polymeric Lens and Unitary Optic Member for LED light Fixtures and Method of Manufacture." Such document discloses a unitary optic member for directing light from a plurality of LED light sources on a board beneath the optic member, the optic member having a plurality of lens portions surrounded by and interconnected by a non-lens portion. The optic member of such document includes a first molded polymeric layer forming the non-lens portion and an outermost layer of each of the lens portions, and a second molded polymeric layer overmolded onto the first polymeric layer within pocket-spaces corresponding to each lens portion. One aspect of the invention disclosed in such document is a multi-layer polymeric lens for directing light from an LED light source, the lens defining a lens optical footprint and at least one of the polymeric layers being less than coextensive with the footprint.

As LED lighting becomes more widespread within the lighting marketplace, there is a continuing need to simplify manufacturing and reduce the number of components within LED light fixtures and fixture components. One way to simplify manufacturing and reduce cost and components is to combine the functions of two or more components into a single component. Another is to utilize materials in a way which takes advantage of the best attributes of each material while at the same time eliminating their less-desirable properties. The present invention utilizes such combination of functions and best attributes to provide a unique LED lensing arrangement for lighting fixtures.

It is an object of the present invention to provide an LED lensing arrangement which combines the best attributes of (1) rigid light-transmissive materials such as optical-grade thermoplastic or glass and (2) less rigid optically-clear polymeric materials, such as liquid silicone rubber (LSR), which are pourable and of low enough viscosity upon formation to allow for specific detailed lens-portion shapes that are maintained during product usage despite the presence of heat and moisture.

Stated differently, it is an object of the invention to provide a multi-material LED lensing arrangement which avoids some of the disadvantages of certain materials when used separately, and to provide an LED lensing arrangement that is moldable in a wide variety of shapes for a wide variety of light-directing purposes. Other objects include to reduce cycle times in the component manufacture, to increase dimensional replication of such components, to increase optical efficiency, to increase photometric accuracy, to increase production throughout rates, and to lower overall cost.

These and other objects of the invention will be apparent from the following descriptions and from the drawings.

SUMMARY OF THE INVENTION

The invention is an LED lensing arrangement for lighting fixtures. The inventive lensing arrangement comprises: (1) a rigid light-transmissive outer structure which has an outwardly-facing light-exit surface and an outer-structure light-input surface; (2) an optically-clear molded polymeric inner structure which has a light-entrance surface and an light-output surface adhered to, and in some cases substantially coextensive with, the outer-structure light-input surface, the inner structure being of a material which is pourable upon molding; and (3) at least one LED light source secured with respect to and optically coupled to the inner-structure light-entrance surface.

The rigid outer structure may be of a rigid light-transmissive polymeric material, an example of which is polymethyl methacrylate (PMMA), or it may be of glass.

As for the optically-clear molded polymeric inner structure, the words "upon molding" used in the phrase "pourable upon molding" in describing such material refers to the condition of the material as it enters the mold which determines its shape. The polymeric material used for the optically-clear inner structure can be described as being of low viscosity upon molding; more specifically, the viscosity upon molding is less than about 10,000 centipoise, and in certain embodiments less than about 5,000 centipoise. The optically-clear inner structure may be of an elastomeric material.

In certain embodiments, including those detailed later herein, the optically-clear inner structure is a liquid silicone rubber (LSR) member. The LSR member may be of an optical-grade LSR, or of another LSR, typically less expensive, which is sufficiently optically clear for lighting-fixture purposes. The inner structure may have a Shore A durometer hardness of less than about 70. Examples of suitable LSRs that may be used in this invention are mentioned below.

The term "optically-clear" as used with respect to the molded inner structure of the LED lensing arrangement of this invention means that the material, once formed, allows passage of light sufficient to efficiently satisfy the requirement for commercial lighting fixtures. The term "optical-grade," is a subset of the term "optically-clear"; "optically-clear" does not necessarily imply "optical-grade."

In many embodiments, the inventive LED lensing arrangement has a plurality of LED light sources along the light-entrance surface of the inner structure. In some of such embodiments, including some described herein, the plurality of LED light sources are arranged substantially along a single line.

In certain embodiments of the inventive LED lensing arrangement, the outer-structure light-input surface and the outwardly-facing light-exit surface are in non-parallel planes, and in some of these embodiments, the outer-structure light-input surface and the outwardly-facing light-exit surface are in substantially perpendicular planes.

In certain specific embodiments of the inventive LED lensing arrangement, the outer structure is a sheet-like member having two principal surfaces and the outer-structure light-input surface, one of the principal surfaces being the outwardly-facing light-exit surface and the other being a light-extraction surface configured to reflect light from the at least one LED light source outward through the outwardly-facing light-exit surface. In certain of such embodiments, the light-extraction surface includes a plurality of angled surfaces.

In certain other embodiments of the inventive LED lensing arrangement, the two principal surfaces are angled to one another such that the outer structure has a wedge-like cross-section in a plane perpendicular to the exit and input surfaces of the outer structure.

In some specific embodiments, the outer-structure light-input surface and the inner-structure light-output surface are planar. This planar-surface-on-planar surface arrangement can be in various configurations and relationships of outer structure and inner structure.

In certain specific embodiments, the outer structure is a sheet-like member having two principal surfaces, one of the two principal surfaces being the outwardly-facing light-exit surface and the other being the outer-structure light-input surface, and the inner-structure light-output surface engages at least a portion of such the outer-structure light-input surface, and in some cases a major portion of the outer-structure light-input surface. The term "major portion," as used herein in referring to the extent of engagement of the inner structure light-output surface with the outer-structure light-input surface when such light-input surface is one of the two principal surfaces of the outer structure, means that the cross-dimensions of the area of surface-to-surface engagement of the inner-structure light-output surface and outer-structure light-input surface constitutes more than half the corresponding cross-dimension of the outer structure (i.e., along the same line).

In certain of such embodiments, the outer-structure light-exit surface is substantially planar, and in certain of these embodiments the outer-structure light-input surface is also substantially planar. In such situations, the outer structure is a flat sheet, which may be a glass sheet or may be of a light-transmissive rigid polymeric sheet, such as PMMA.

In certain of such embodiments, the optically-clear molded polymeric inner structure, in addition to having the light-output surface, has its light-entrance surface along a light-entrance edge of the inner structure, such light-entrance edge being shaped to receive the at least one LED light source, and, opposite the light-output surface, such inner structure also has a surface with molded light-extraction characteristics specifically configured to direct light from the light-entrance surface to and through the outer structure. Such inner structure may be a liquid silicone rubber (LSR) member, as discussed above.

Another aspect of this invention is an LED lighting fixture including an LED lensing arrangement as described above.

The term "LED light source" as used herein refers to an LED or a small grouping of LEDs, either alone or more typically, a small grouping of LEDs in what is referred to as an LED package. LED light sources typically have a primary lens formed thereon.

The term "sheet-like member having two principal surfaces," as used herein with respect to certain examples of a rigid light-transmissive outer structure, means that the member has two outer opposed surfaces that are large compared to its other outer surfaces, which are edges and/or ends of the outer structure.

The term "light-extraction surface," as used herein, refers to a particular configuration of a surface of a light-transmissive structure. Such surface is configured to have a plurality of ridges or other surface features such that light which has entered such structure at an edge thereof and proceeds from there along the subject surface encounters such ridges or other surface features and is thereby redirected out of such light-transmissive structure in a generally intended direction. Two sorts of light-extraction surfaces are seen in examples of this invention described herein. In one case, the light-extraction surface is a surface of the rigid light-transmissive outer structure, and in the other it is a surface of the optically-clear molded polymeric (e.g., LSR) inner structure.

In the example in which the light-extraction surface is a surface of the rigid outer structure, one of the two principal surfaces of the rigid structure as mentioned above is an outwardly-facing light-exit surface and the other is the light-extraction surface. And, when light enters the outer structure through the outer-structure light-input surface (which is an edge of the outer structure extending between its principal surfaces) and proceeds therefrom along the light-extraction surface, much of this light is redirected by the light-extraction surface to exit the outer structure of the LED lensing arrangement though the outwardly-facing light-exit surface.

In the example in which the light-extraction surface is a surface of the molded polymeric inner structure (e.g., a structure which is of LSR), the principal surface of the rigid outer structure which is opposite the outwardly-facing light-exit surface of such outer structure is the outer-structure light-input surface, and this outer-structure light-input surface has the inner-structure light-output surface engaging at least a portion of it, often a major portion of it. In such situations, the inner structure has the its light-entrance surface along what can be referred to as a light-entrance edge of the inner structure, and the surface of the inner structure opposite the inner-structure light-output surface is the light-extraction surface. When light enters the LSR or other molded polymeric inner structure through the light-entrance edge thereof and proceeds therefrom along the light-extraction surface, much of this light is redirected by the light-extraction surface to exit the inner structure and pass through the rigid outer structure of the LED lensing arrangement of this invention.

In descriptions of this invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 10 is an inside face view of another embodiment of the LED lensing arrangement of this invention.

FIG. 11 is an inside face view of still another embodiment.

FIG. 12 is a right-side elevation of the device of FIG. 11.

FIG. 12A is a fragmentary magnified view of an edge portion of the device as in FIG. 12, as indicated by magnification marking 12A in FIG. 12.

DETAILED DESCRIPTION OF CERTAIN EMBODIMENTS

FIGS. 1-9 illustrate an LED lensing arrangement 20 for lighting fixtures which is one embodiment of this invention. Lensing arrangement 20 includes a rigid light-transmissive outer structure 22, an optically-clear molded polymeric inner structure 24, which is injection molded liquid silicone rubber (LSR), secured with respect to rigid outer structure 22, and a narrow elongate circuit board 26 having a row of LED light sources 26A thereon which are aligned with and adjacent to LSR inner structure 24.

Figure 1:
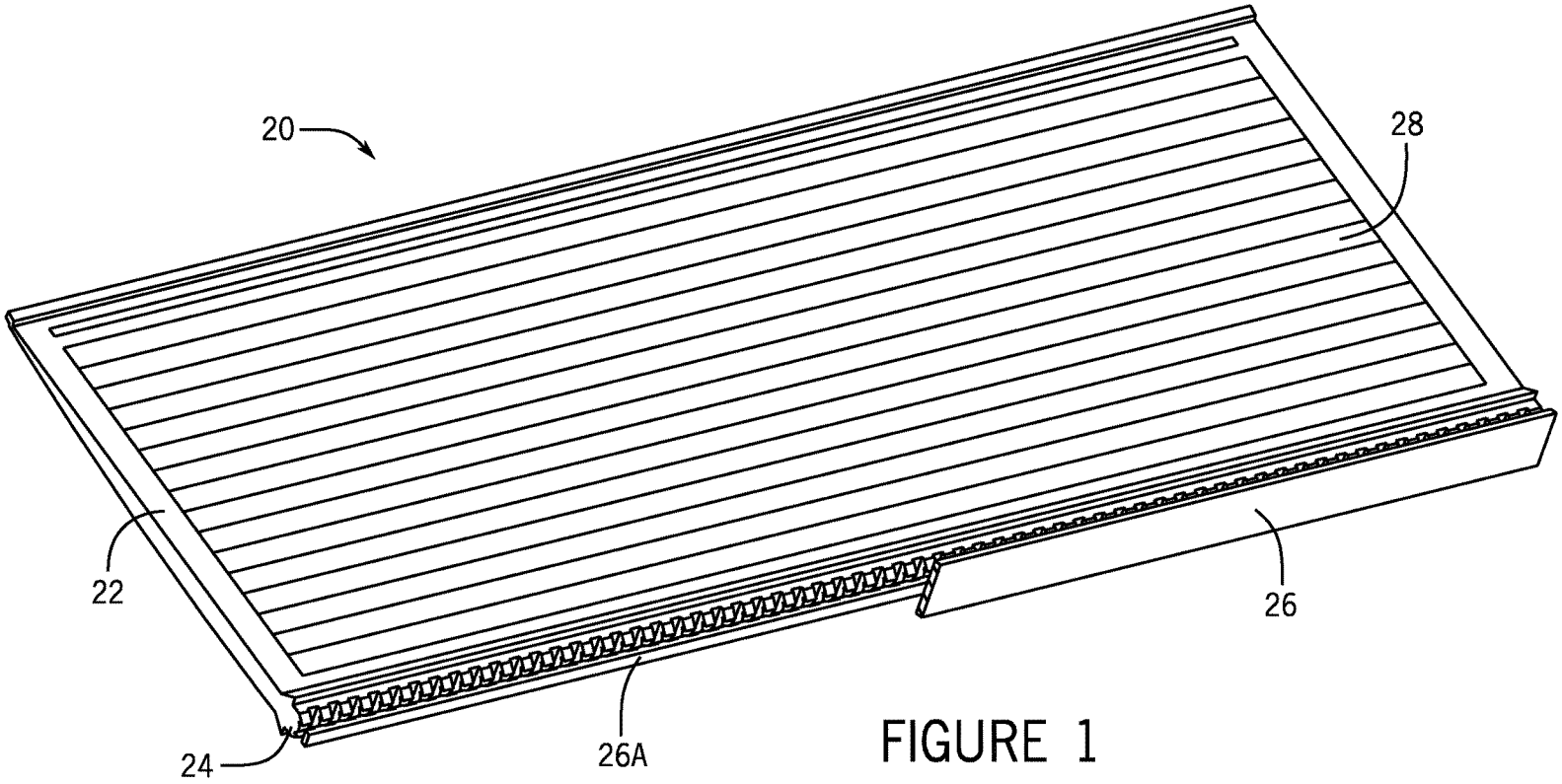
FIG. 1 is a partially broken-away isometric view of an LED lensing arrangement in accordance with an embodiment of this invention for use in lighting fixtures.
Figure 2:
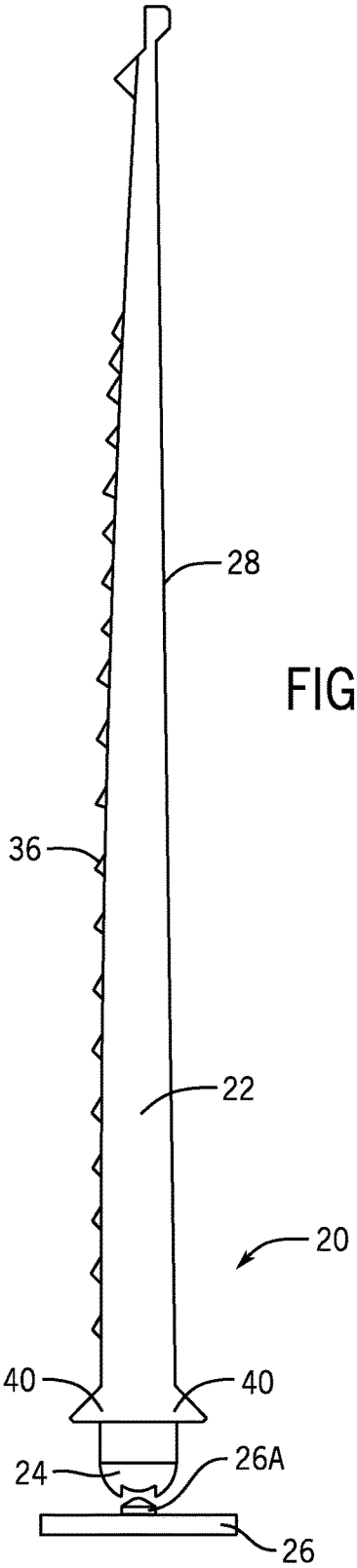
FIG. 2 is an enlarged left end elevation of the LED lensing arrangement of FIG. 1.
Figure 4:
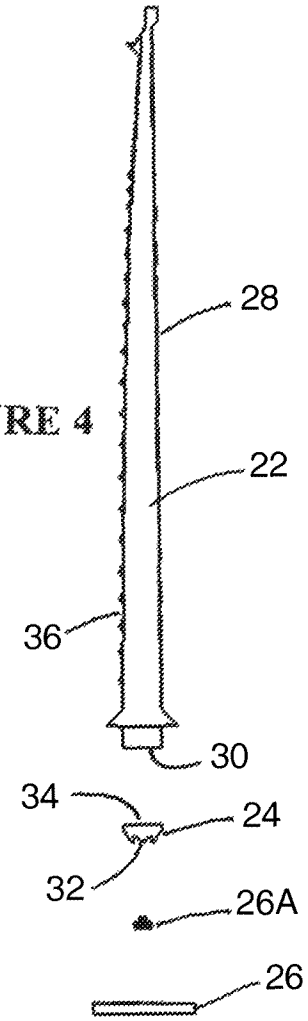
FIG. 4 is an enlarged right-end elevation of the device as seen in FIG. 3, exploded as in such figure.
Figure 3:
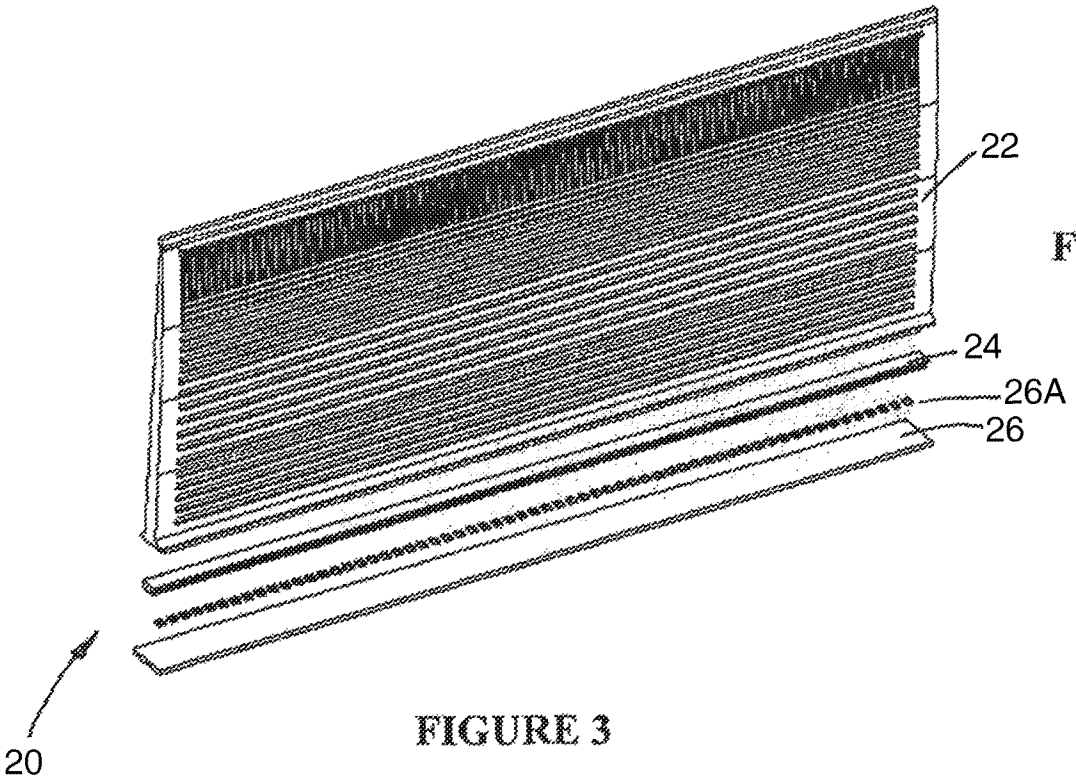
FIG. 3 is a exploded isometric view of the LED lensing arrangement of FIG. 1, but taken from a different angle than is seen FIG. 1, so that the opposite face of the rigid light-transmissive outer structure is seen.
Figure 5:
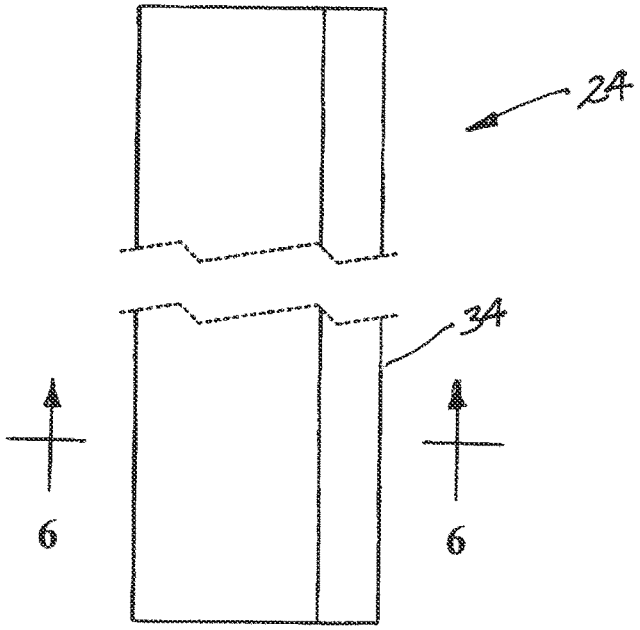
FIG. 5 is an enlarged fragmentary side view of the light-transmissive inner structure of such LED lensing arrangement, such inner structure being of liquid silicone rubber (LSR).

As shown best in FIGS. 2 and 4, rigid outer structure 22 has an outwardly-facing light-exit surface 28, which is one of the two opposed principal surfaces (faces) of rigid outer structure 22, and an outer-structure light-input surface 30, which is along one of the edges of rigid outer structure 22. In the embodiment shown in FIGS. 1-9, outer-structure light-input surface 30 extends between the two principal surfaces of rigid outer structure 22. Thus, outer-structure light-input surface 30 and outer-structure light-exit surface 28 are in non-parallel planes; such planes are substantially perpendicular to one another.

Figure 6:
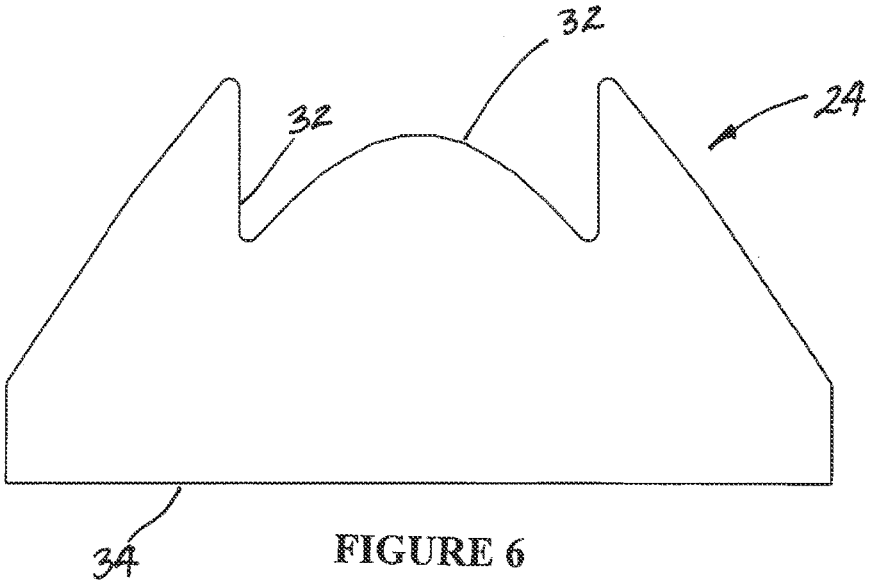
FIG. 6 is a further-enlarged sectional view, without cross-hatching, of the inner structure, taken along section 6-6 as shown in FIG. 5.
Figure 7:
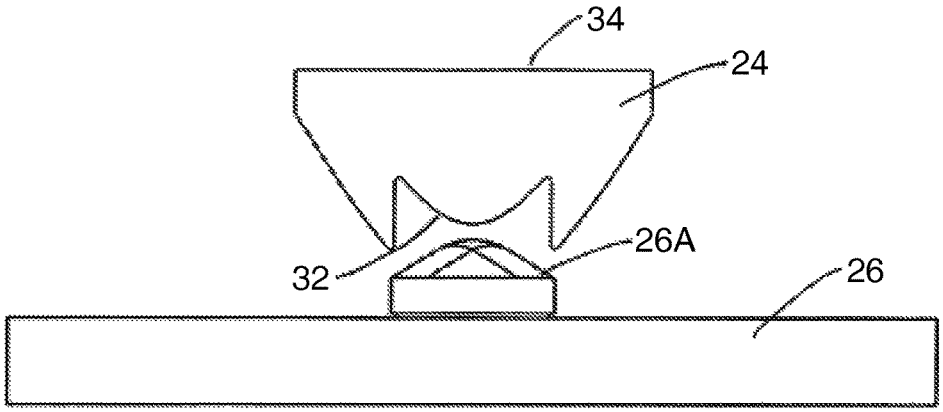
FIG. 7 is a less-enlarged sectional view, without cross-hatching, of the circuit board and an LED light source thereon in its light-transmitting relationship to the light-transmissive inner structure.
Figure 8:
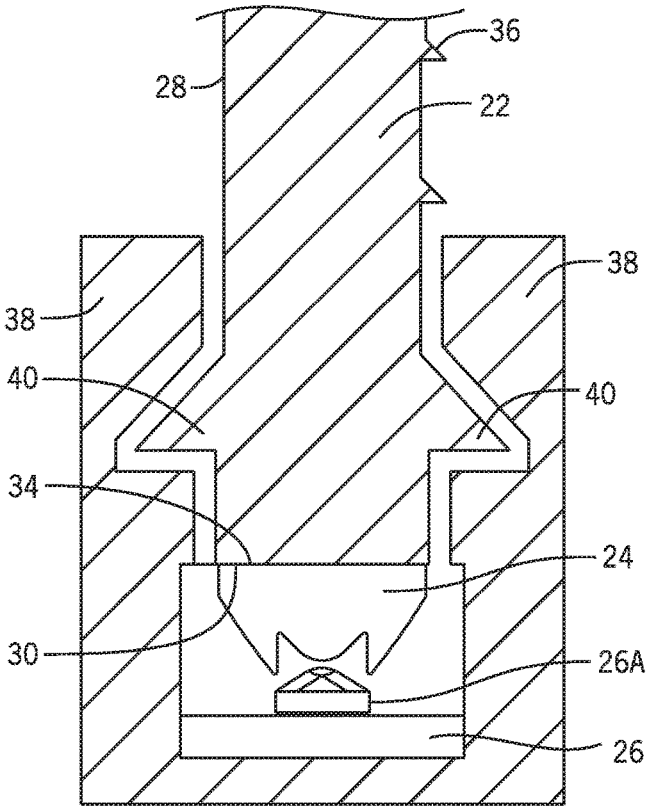
FIG. 8 is a schematic sectional view, without full cross-hatching, of a portion of a lighting fixture using the subject LED lensing arrangement, particularly showing how the positional relationship of the circuit board and the LED light sources thereon is maintained with respect to the rigid light-transmissive outer structure and the light-transmissive LSR inner structure thereon.

As shown best in FIGS. 6-8, LSR inner structure 24 has a light-entrance surface 32 which is adjacent to LED light sources 26A on circuit board 26, and an inner-structure light-output surface 34 which is adhered to and substantially coextensive with light-input surface 30 of rigid outer structure 22. As seen best in FIGS. 7-9, LED light sources 26A are optically coupled with light-entrance surface 32 of inner structure 24. Light-output surface 34 of inner structure 24 and light-input surface 30 of rigid outer structure 22 are both planar, and may be adhered to one another by an acceptable optical-adhesive material (not shown).

As shown in FIG. 8, elongate circuit board 26, which bears the row of LED light sources 26A, is secured to rigid outer structure 22 by means of an elongate holding member 38 which engages circuit board 26 and extends on either side of LSR inner structure 24 to engage a pair of elongate flanges 40 of rigid outer structure 22. The parts and pieces are configured to establish the intended positions of outer and inner structures 22 and 24. By this means, LED light sources 26A are secured with respect to light-entrance surface 32 of inner structure 24, slightly spaced therefrom, to maximize the intended optical coupling.

In the embodiment of FIGS. 1-9, rigid outer structure 22 is a sheet-like member which, as noted above, has two opposed principal surfaces. One of these is outer-structure light-exit surface 28, mentioned above, and the other is a light-extraction surface 36 of rigid outer structure 22. Light-extraction surface 36 of outer structure 22 is configured to redirect (by reflection) light, i.e., light that has come from LED light sources 26A, through inner structure 24, into outer-structure light-input surface 30 and from there generally along light-extraction surface 36, outwardly through outer-structure light-exit surface 28. In this manner light exits LED lensing arrangement 20 in intended directions.

Figure 9:
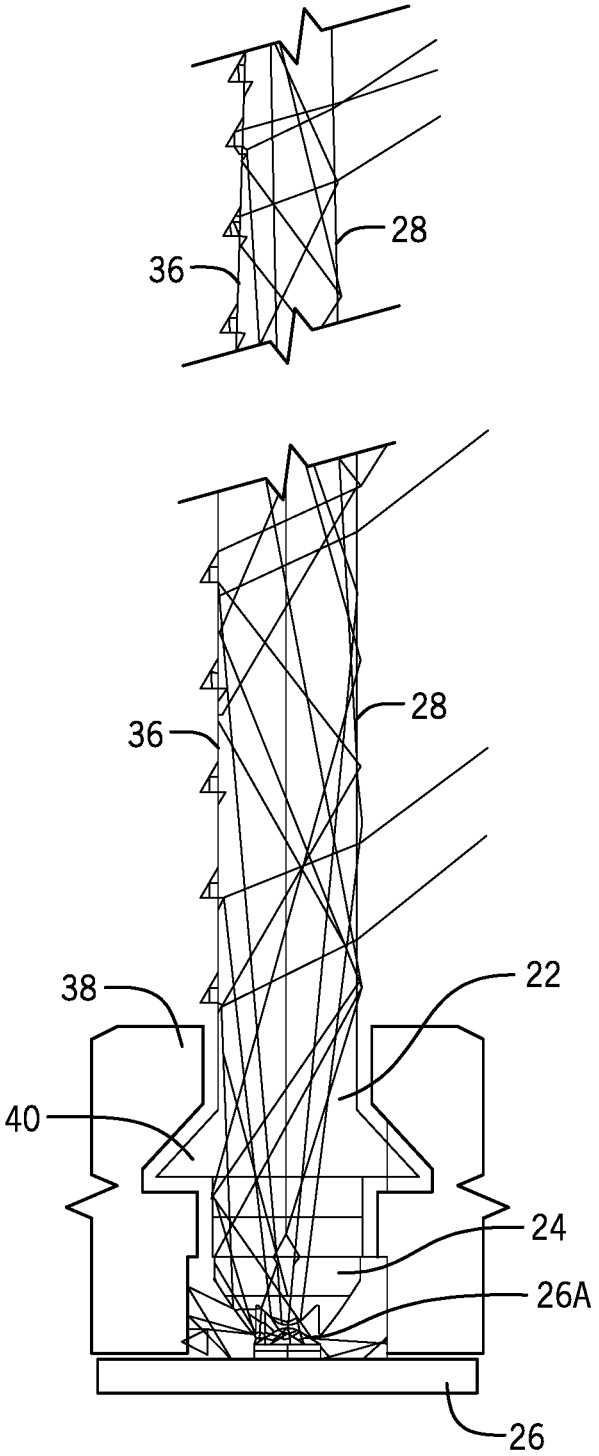
FIG. 9 is a partially broken-away side sectional view, without cross-hatching, of the LED lensing arrangement illustrated in FIGS. 1-8, providing a ray trace serving to illustrate light movement into, within, and out of the LED lensing arrangement.

As can be seen best in the cross-section ray-trace view of FIG. 9, light-extraction surface 36 in the embodiment illustrated in FIGS. 1-9 includes a plurality of angled surfaces (ridges) oriented to reflect light coming from outer-structure light-input surface 30 in a direction toward light-exit surface 28. The ray trace of FIG. 9 shows how there is considerable reflection occurring along the light-movement length of outer structure 22, including total internal reflection (TIR) causing light to progress along outer structure 22 and reflection causing light to pass through outer-structure light-exit surface 28 to an intended target area. FIG. 9 also illustrates the passage of light into and out of inner structure 24.

The specific configuration utilized will be determined by, among other things, the light-directing characteristics desired for a light fixture using this aspect of the invention.

Light-exit surface 28 of rigid light-transmissive outer structure 22 may in certain applications be facing downward when LED lensing arrangement 10 is used in a lighting fixture for lighting on streets, roadways, or other horizontal surfaces below the lighting fixture.

Rigid outer structure 22 may be made of a variety of rigid polymeric materials formed in any of known plastic forming methods. One particularly useful polymeric material is polymethyl methacrylate (PMMA), which has suitable qualities for use in this invention. Other suitable polymeric materials for rigid outer structure 22 would be well known to those skilled in the lensing art. Alternatively, the rigid outer structure may be glass formed to the desired shape. In some situations, rigid outer structure 22 may be substantially planar. In such situations, the outer structure is a flat sheet, which may be a glass sheet or may be of a light-transmissive rigid polymeric sheet.

As indicated above, the optically-clear molded polymeric inner structure, which is of a material which is pourable upon molding (or, described differently, is of a sufficiently low viscosity upon molding), may be of a elastomeric material such as liquid silicone rubber (LSR). Such LSR member may have a Shore A durometer of less than about 70. So-called optical-grade LSRs may be used, but other optically-clear LSRs may be used.

Examples of acceptable LSR materials include: EI-1164 liquid silicone rubber from Dow Corning and Elastosil® RT 601 A/B liquid silicone rubber from Wacker Silicones. Such Dow Corning LSR is pourable upon molding, having a viscosity of 4600 and when formed having a Shore A durometer hardness of 64. The Wacker LSR is pourable upon molding, having a viscosity of 3500 at 23° C., and when formed having a Shore A durometer hardness of 45. A variety of other LSR materials would also be acceptable for use in this invention.

FIG. 10 illustrates an LED lensing arrangement 70 which is another embodiment of this invention, and FIGS. 11, 12 and 12A illustrate an LED lensing arrangement 70 which is still another embodiment. Lensing arrangements 50 and 70 have proportionally greater areas of surface-to-surface engagement of their respective inner-structure light-output surfaces with their respective outer-structure light-input surfaces. The optically-clear molded polymeric inner structures of such embodiments may be formed of LSR. And, each of inner structures of lensing arrangements 50 and 70 has its light-entrance surface along a light-entrance edge of the inner structure, such light-entrance edges being shaped to receive one or more LED light source; and, opposite its light-output surface, each such inner structure also has a surface with molded light-extraction characteristics specifically configured to redirect light from the light-entrance surface to and through the respective outer structure.

These additional embodiments will now be described in more detail.

Lensing arrangement 50 of FIG. 10 includes a rigid outer structure 52 and an LSR inner structure 54. Rigid outer structure 52 is a flat sheet which projects beyond the edges 56 of LSR inner structure 54. Rigid outer structure 52 may be of a rigid polymeric materials such as PMMA or may be glass.

Rigid outer structure 52 has two planar surfaces, one of which is the outer-structure light-exit surface (not seen because it is the back surface of outer structure 52 in the figure) and the other of which is the opposite surface, referred to herein as outer-structure light-input surface 60. As can be seen in FIG. 10, outer-structure surface 60 includes a portion projecting beyond edges 56 of inner structure 54 as well as the remaining portion which is behind LSR inner structure 54, and which therefore is the portion (not directly seen) of outer-structure surface 60 through which light from inner-structure light-output surface (also not directly seen) passes into outer-structure light-input surface 60. As can be seen in FIG. 10, in LED lensing arrangement 50 the inner-structure light-output surface engages a major portion of the outer-structure light-input surface.

Outer-structure light-input surface 60 is engaged by the inner-structure light-output surface (not directly seen). The flat surfaces of rigid outer structure 52 and LSR inner structure 54 are adhered to one another. The corresponding flat surfaces of the inner and outer structures may be adhered using a suitable optical adhesive, such as an index-matched adhesive, or primer. Surface-to-surface adhesion of such lensing structures may be facilitated by surface etching that tends to increase the engagement of the inner-structure material with the outer surface material.

As seen in FIG. 10, LSR inner structure 54 of LED lensing arrangement 50 includes a light-entrance surface 62 along an edge thereof through which light from an LED light source (not shown) enters inner structure 54. Optically-clear molded-LSR inner structure 54 also includes, opposite its light-output surface (not shown), a light-extraction surface 66 having molded light-extraction ridges 66A specifically configured to redirect light from light-entrance surface 62 to and through rigid outer structure 52.

Turning now to LED lensing arrangement 70 which is illustrated in FIGS. 11, 12 and 12A and has some similarity to LED lensing arrangement 50, lensing arrangement 70 includes a rigid outer structure 72 and an LSR inner structure 74. As in LED lensing arrangement 50, rigid outer structure 72 is a flat sheet and may be of a rigid polymeric materials such as PMMA or may be glass. However, unlike in LED lensing arrangement 50, LSR inner structure 74 has an inner-structure light-output surface 84 which is coextensive with outer-structure light-input surface 80; in other words, surface 84 is engaged with a major portion of surface 80, in this case all of surface 80. This is seen in FIG. 12A.

As seen in FIG. 11, LSR inner structure 74 of LED lensing arrangement 70 includes a light-entrance surface 82 along a projecting edge thereof through which light from plural LED light sources (not shown) enters LSR inner structure 74. As shown in FIGS. 11 and 12 and also with reference to FIG. 12A, LSR inner structure 74 also includes, opposite light-output surface 84, a light-extraction surface 86 which has molded light-extraction ridges 86A configured to redirect light from light-entrance surface 82 to and through rigid outer structure 72, such that light exits outer-structure light-exit surface 78 of LED lensing arrangement 70 to the intended target area.

While the principles of this invention have been described in connection with specific embodiments, it should be understood clearly that these descriptions are made only by way of example and are not intended to limit the scope of the invention.

The invention claimed is:

1. An LED lensing arrangement for lighting fixtures comprising:

a rigid light-transmissive outer structure having a light-exit surface and an elongate outer-structure light-input surface;

an elastomeric optically-clear inner structure having a light-entrance surface defining an inner cavity with a light-receiving opening, a pair of outward lateral surfaces configured for receiving and redirecting lateral light from the inner cavity toward an elongate light-output surface which is adhered to the elongate outer-structure light-input surface; and at least one LED light source optically coupled with respect to and spaced from the light-entrance surface of the elastomeric inner structure.

2. The LED lensing arrangement of claim 1 having a plurality of LED light sources.

3. The LED lensing arrangement of claim 1 wherein the outer-structure light-input surface and the light-exit surface are in non-parallel planes.

4. The LED lensing arrangement of claim 3 wherein the outer-structure light-input surface and the light-exit surface are in substantially perpendicular planes.

5. The LED lensing arrangement of claim 4 wherein the outer structure is a sheet-like member having two principal surfaces and the outer-structure light-input surface, one of the two principal surfaces being the light-exit surface and the other being a light-extraction surface configured to reflect light from the at least one LED light source toward the light-exit surface.

6. The LED lensing arrangement of claim 5 having a plurality of LED light sources along the light-entrance surface.

7. The LED lensing arrangement of claim 6 wherein the plurality of LED light sources are arranged substantially along a single line.

8. The LED lensing arrangement of claim 5 wherein the light-extraction surface includes a plurality of angled surfaces.

9. The LED lensing arrangement of claim 5 wherein the two principal surfaces are angled to one another such that the outer structure has a wedge-like cross-section in a plane perpendicular to the light-exit and light-input surfaces of the outer structure.

10. The LED lensing arrangement of claim 1 wherein the outer-structure light-input surface and the inner-structure light-output surface are planar.

11. The LED lensing arrangement of claim 1 wherein the inner-structure light-output surface is substantially coextensive with the outer-structure light-input surface.

12. The LED lensing arrangement of claim 1 wherein the inner structure is adhered to a glass sheet which forms the rigid outer structure.

13. The LED lensing arrangement of claim 1 wherein the inner structure is a liquid silicone rubber (LSR) member.

14. The LED lensing arrangement of claim 13 wherein the LSR is an optical-grade LSR pourable upon molding.

15. The LED lensing arrangement of claim 13 wherein the LSR member has a Shore A durometer hardness of less than about 70.

16. The LED lensing arrangement of claim 1 wherein the outer structure is a sheet-like member having two principal surfaces and the outer-structure light-input surface, one of the two principal surfaces being the light-exit surface and the other being a light-extraction surface configured to reflect light from the at least one LED light source toward the outwardly-facing light-exit surface.

17. The LED lensing arrangement of claim 16 wherein the light-extraction surface includes a plurality of angled surfaces.

18. The LED lensing arrangement of claim 16 wherein the two principal surfaces are angled to one another such that the outer structure has a wedge-like cross-section in a plane perpendicular to the exit and input surfaces of the outer structure.

19. The LED lensing arrangement of claim 1 wherein the inner structure further comprises a surface with molded light-extraction characteristics configured to direct light from the light-entrance surface toward the light-output surface, the light-entrance surface being along a light-entrance edge configured to receive light from the at least one LED light source.

20. An LED lensing arrangement for lighting fixtures comprising:

a rigid light-transmissive outer structure having a light-exit surface and an outer-structure light-input surface substantially coextensive with the light-exit surface;

an elastomeric optically-clear inner structure having a light-entrance surface and a light-output surface which is adhered to the outer-structure light-input surface; and at least one LED light source optically coupled with respect to the light-entrance surface of the elastomeric inner structure.

21. The LED lensing arrangement of claim 20 having a plurality of LED light sources.

22. The LED lensing arrangement of claim 20 wherein the light-entrance surface of the inner structure and the light-exit surface of the outer structure are in non-parallel planes.

23. The LED lensing arrangement of claim 22 wherein the outer-structure light-input and light-exit surfaces are in substantially parallel planes.

24. The LED lensing arrangement of claim 23 wherein the outer-structure light-input surface and the inner-structure light-output surface are planar.

25. The LED lensing arrangement of claim 23 wherein the inner-surface light-output surface is substantially coextensive with the outer-structure light-input surface.

26. The LED lensing arrangement of claim 22 having a plurality of LED light sources along the inner-structure light-entrance surface.

27. The LED lensing arrangement of claim 26 wherein the plurality of LED light sources are arranged substantially along a single line.

28. The LED lensing arrangement of claim 20 wherein the outer-structure light-exit surface is substantially planar.

29. The LED lensing arrangement of claim 20 wherein:

the outer structure is a sheet-like member having two principal surfaces, one of the two principal surfaces being the light-exit surface and the other being the outer-structure light-input surface; and the inner-structure light-output surface engages at least a portion of the outer-structure light-input surface.

30. The LED lensing arrangement of claim 29 wherein the inner-structure light-output surface engages a major portion of the outer-structure light-input surface.

31. The LED lensing arrangement of claim 29 wherein the inner structure further comprises a surface with molded light-extraction characteristics configured to direct light from the light-entrance surface toward the light-output surface, the light-entrance surface being along a light-entrance edge configured to receive light from the at least one LED light source.

32. The LED lensing arrangement of claim 31 wherein the outer structure is a glass sheet.

33. The LED lensing arrangement of claim 32 wherein the inner structure is a liquid silicone rubber (LSR) member.

34. The LED lensing arrangement of claim 33 wherein the LSR is an optical-grade LSR pourable upon molding.

35. The LED lensing arrangement of claim 33 wherein the LSR member has a Shore A durometer hardness of less than about 70.

36. The LED lensing arrangement of claim 20 wherein the outer-structure light-input surface is substantially planar.

37. The LED lensing arrangement of claim 36 wherein the outer structure is a substantially planar glass sheet.

38. The LED lensing arrangement of claim 20 wherein the inner structure is adhered to a glass sheet forming the rigid outer structure.

39. The LED lensing arrangement of claim 20 wherein the inner structure is of a liquid silicone rubber (LSR) having a viscosity less than about 10,000 centipoise upon molding.

40. The LED lensing arrangement of claim 39 wherein the LSR has a viscosity less than about 5,000 centipoise upon molding.

41. The LED lensing arrangement of claim 40 wherein the LSR member has a Shore A durometer hardness of less than about 70.

* * * * *